United States Patent [19]

More et al.

[11] Patent Number: 5,027,129

[45] **Date of Patent: * Jun. 25, 1991**

[54] GIMBALLED ANTENNA

[75] Inventors: Henry S. More; Louis H. Rorden, both of Los Altos, Calif.; Neil H. Akkerman, Houston, Tex.

[73] Assignee: Develco, Inc., San Jose, Calif.

[ * ] Notice: The portion of the term of this patent subsequent to May 15, 2007 has been disclaimed.

[21] Appl. No.: 419,893

[22] Filed: Oct. 11, 1989

Related U.S. Application Data

[63] Continuation of Ser. No. 865,623, May 21, 1988, Pat. No. 4,926,188.

[51] Int. Cl.[5] ..... H01Q 1/04

[52] U.S. Cl. ..... 343/719; 343/787

[58] Field of Search ..... 343/719, 873, 878, 882, 343/757, 787, 765; 340/854

[56] References Cited

U.S. PATENT DOCUMENTS

| | | | |
|---|---|---|---|
| 2,067,337 | 1/1937 | Polatzek | 343/719 |
| 2,757,738 | 8/1956 | Ritchey | 343/719 |
| 4,583,589 | 4/1986 | Kasevich | 343/719 |

*Primary Examiner*—Michael C. Wimer
*Assistant Examiner*—Hoanganh Le
*Attorney, Agent, or Firm*—Flehr, Hohbach, Test, Albritton & Herbert

[57] ABSTRACT

A modified subterranean antenna structure for use in boreholes that pivotally balances a separate core member within the hollow interior of a fixed winding member in order to filter out mechanically induced vibrations from the core. The mechanical natural resonant frequency of the core is reduced and becomes less than the lowest electromagnetic signal frequency intended to be transmitted to and received by the subterranean antenna. In this way, mechanically induced vibrations will not create mechanically generated frequency signals sympathetic to the frequencies chosen for the antenna communication band frequencies.

8 Claims, 4 Drawing Sheets

GIMBALLED ANTENNA

This is a continuation of application Ser. No. 06/865,623 filed May 21, 1988, now U.S. Pat. No. 4,926,188.

FIELD OF THE INVENTION

A subterranean antenna mounting system for isolating the antenna that forms part of a wireless electromagnetic communication system from mechanically induced motion in order to lower the natural resonant frequency of the antenna to a frequency less than the lowest electric signal frequency to be received by that antenna for communication purposes.

BACKGROUND OF THE PRESENT INVENTION

In drilling wells associated with oil and gas exploration, and subsequently when such wells are producing wells, various types of communication techniques and systems have been developed for monitoring and/or controlling well operation. Such systems not only transmit well data related to the operation and functioning of the well, but also transmit operational commands to control valves and other apparatus in the borehole.

One such system, in the form of a wireless, subterranean electromagnetic communication system, is described in Rorden, U.S. Pat. No. 3,967,201, where a relatively low frequency, wireless electromagnetic communication link is established through suitable transmitters and a subterranean antenna.

The subterranean antenna described there included a ferromagnetic core which was surrounded by a solenoidal electrical winding. The core of the antenna was, in fact, formed from a plurality of closely packed ⅝ths inch diameter ferrite rods, each having a circular cross-section and being about ten feet in length. The ferrite rods are described as being potted in a high density polyurethane foam inside of a fiberglass coil, with the solenoidal winding itself being wound around the fiberglass coil and then covered with an insulating material and then with a metal coated mylar shield.

We are also aware of More U.S. Pat. No. 4,216,536, which deals with apparatus for transmitting well data from a downhole location to the surface of the earth and for checking upon the accuracy of that data. This transmission system sends a first set of signals to a computer located at a downhole location. A second set of signals are generated and transmitted to the surface through a second transmission system. When the drilling operation is halted and the drill string brought to the surface, the two sets of data can then be compared. Following such a comparison, the two sets of data are synchronized; and if there is a discrepancy between the data, the discrepancies are analyzed, problems pinpointed, and corrective measures taken to improve the ability of the wireless system to correctly transmit data during subsequent drilling.

Other patents that also generally deal with apparatus for sensing downhole conditions or controlling operations at downhole locations include Connor, Sr., U.S. Pat. No. 3,665,955, Skinner, U.S. Pat. No. 4,426,882, and Maddock, Jr., U.S. Pat. No. 4,483,187.

In dealing with downhole signal transmission, it has become evident that when low frequency signals are being used to provide control over well operations, such as, for example, subsurface safety valves for controlling flow, it is important to provide the precise control signal to accomplish a particular objective at the desired time. It is not desirable to have such a signal generated erroneously as that would not provide the needed control over well operation. Thus, it is important to have a subsurface antenna capable of receiving low frequency electromagnetic signal transmissions from transmitters positioned at surface or other locations, in an accurate manner without interference from downhole conditions as might be created by the material flowing through the borehole. Mechanically induced resonant frequencies in a frequency range within that at which the low frequency electromagnetic signals are to be sent would, of course, produce the possibility of erroneous signal generation. It is desired, therefore, to have a method and structure by which the receiving antenna is mechanically isolated from mechanical motions that might otherwise couple natural resonant frequencies generated thereby into the antenna structure. This is especially desirable where such mechanically generated frequencies would be within the frequency range of the low frequency electromagnetic signals being transmitted to and received by that antenna.

To accomplish the mechanical isolation of the receiving antenna from mechanical motions it was determined to employ a gimballed mounting arrangement for the antenna. Such an arrangement would place the center of gravity of the antenna core very close to or in the plane defined by the balance points of the gimballed mount as is more fully discussed below.

Antenna structures used before the present invention were solid structures similar to that in Rorden where the core and the winding were one piece. It was not possible to effectively isolate such an antenna structure because such a design would be difficult to appropriately balance at its center of gravity due to differential thermal expansion rates of its component parts. That is, one design difficulty was to maintain the balance point over a wide temperature range of thermal expansion effects within the plurality of different materials from which the antenna was constructed, since such differential expansion or contraction would give rise to shifts in the center of gravity. This could occur because the core was formed from a magnetic alloy wound with copper and placed inside a stainless steel tube which was then potted using an epoxy or rubber compound. This variety of different materials all expanding at different rates would cause the center of gravity to shift. There were also problems of how to effectively wire the antenna structure. The wiring to the windings for such an antenna structure would have to be led over any isolating mounting structure and would constitute a spring connection tending to offset the balanced antenna.

SUMMARY OF THE PRESENT INVENTION

It was determined that if the core, the flux concentrator/sensor in the antenna, could itself be separately supported and balanced within the rest of the antenna structure, the core could then be constructed from a single material thereby minimizing the effects of thermal expansion on the portion being balanced. This would also eliminate the need to run wires over the mounting structure to the windings. Accordingly, the coil of the antenna of the invention has been provided with a shaped hollow interior. The core portion of the antenna is then positioned within that hollow winding interior and is balanced therein at its center of gravity. Preferably the core is supported at its center of gravity in a gimballed fashion with the windings being fixed with respect to the gimballed core supports.

Accordingly, the present invention seeks to isolate the separate core portion of a subterranean antenna from mechanically induced vibrations so that its natural resonant frequency, the mechanical frequency, is reduced to about ten times less than the lowest frequency at which low frequency electromagnetic control signals will be transmitted to and received by the antenna.

It is also desirable to be able to mount the core within the winding so that the core element together with its gimballed mounting system can be raised vertically between a raised and lowered position within the hollow winding. It is desirable to be able to raise the core when the temperature thereof is at a preselected temperature between the cold or earth's surface temperatures and the hot, subterranean temperatures. This lifting is also desired to protect the gimballed mounting structure from damage as might occur during insertion of the subterranean antenna into its desired position within the borehole.

Temperatures within the borehole can vary anywhere from about 75° C. to about 400° C. with surface temperatures varying around approximately 25° C. It is most desirable to keep the gimballed core in a lifted or non-gimbal supported position at temperatures less than about 50° C. and to allow the gimballed support for the core to be established at temperatures greater than about 50° C.

Other objects, features, and characteristics of the present invention, as well as the methods and operation and function of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EXEMPLARY EMBODIMENTS

Figure 1:
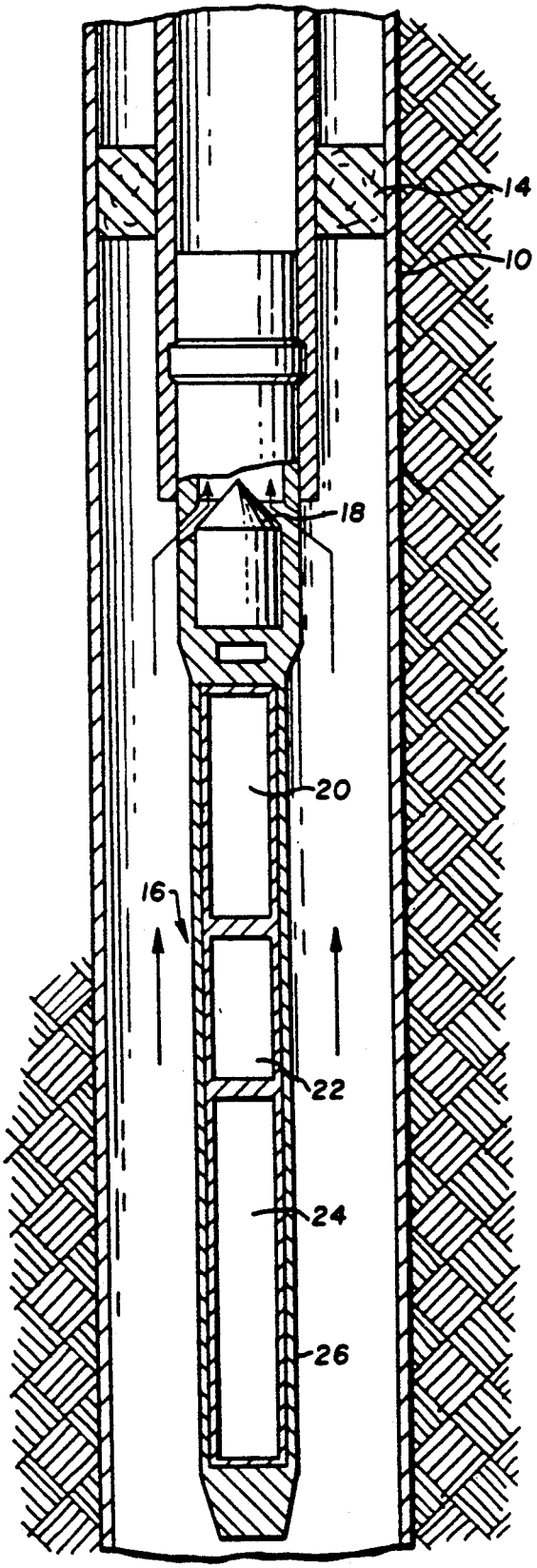
FIG. 1 is a diagrammatic, side elevation view of a subterranean antenna and valve assembly to show the position of an antenna in such a device.

Turning our attention first to FIG. 1, the downhole communication system is positioned in an outer well casing 10, and below an inner casing or flow tube 12. Packer 14 is provided as a seal between casings 10 and 12 to allow flow only through flow tube 12. The downhole control apparatus is generally indicated at 16 and is comprised of a valve mechanism 18, an onboard power source such as batteries 20, an electronics control package 22 and a subterranean antenna 24. Each of the above components is held in a pressure-proof outer housing 26 that is supported below flow tube in a conventional fashion. With the valve mechanism in its open condition, as shown, flow of material from the well can proceed through flow tube 12. Should the valve mechanism close, flow would be terminated.

Figure 2:
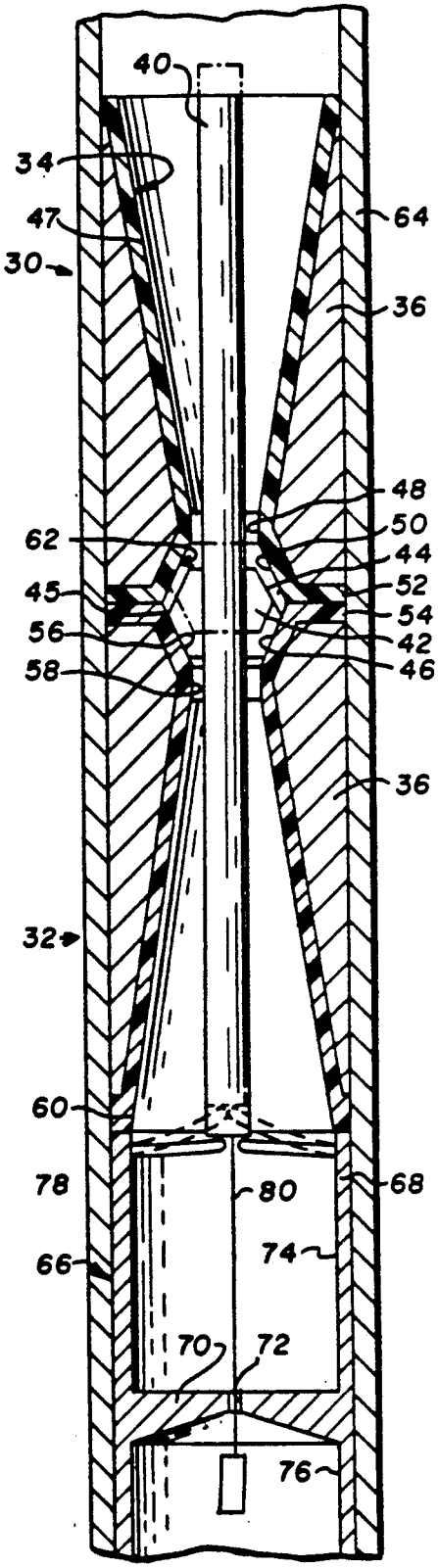
FIG. 2 is a diagrammatic cross-section of one embodiment of the present invention showing a gimballed core in a subterranean antenna structure.

With reference to FIG. 2, one embodiment of the present invention is set forth and is comprised of a two part winding section, the upper winding section being generally indicated at 30 and the lower winding section being generally indicated at 32. Both the upper and lower sections include a hollow interior formed by an inner member or trumpet 34, preferably formed from a higher resistance material such as stainless steel or fiberglass. Trumpet 34 is shaped to provide the desired hollow interior with copper wire being wound therearound in the form of a conventional coil winding 36. Each winding section 30 and 32 is constructed in the same manner and when formed together, will receive a balanced core 40 therein. Core 40 is shown in full line in its operating position and in phantom in its raised, non-operating or lifted position. Core 40 is preferably comprised of a single material such as Permalloy 80 Ni. In the implementation of this embodiment that has been built, the core 40 is approximately 40 inches in length and has an outer diameter of about 0.375 inches with the winding length being approximately 30 inches.

While there are other materials from which core 40 could be constructed, what is important is to have the core constructed from a material exhibiting a high magnetic permeability.

Mounted to the center of core 40 is a gimballed mounting device 42 which includes upper and lower angled support surfaces 44 and 46 which define at their juncture a point or line 45. The gimballed mount 42 is positioned so that the point or line 45 lies in a plane extending normally through the center of gravity of core 40. Trumpet member 34 in the upper section 30 begins with the larger portion of an inwardly tapering, conically shaped surface 47 with the innermost tapered part defining a narrowed neck portion 48. The trumpet shape then flares outwardly again to define an oppositely tapering conical surface 50 that terminates at an outwardly extending horizontal flange 52. Flange 52 will mate with a similar horizontal flange 54 of the trumpet 34 of the lower winding section 32, as shown in FIG. 2. Further, similar opposing conical surfaces 56 and 60 are provided in the lower trumpet and define between them a constricted neck portion 58 similar to neck 48, with neck portions 48 and 58 being uniformly spaced from the central horizontal axis of the windings defined between flanges 52 and 54. The two conical surfaces 50 and 56, together with neck portions 48 and 58 define an interior chamber 62 in which the gimballed mounting device 42 is received when the upper and lower winding sections are mounted in place over core 40. While these winding sections can be connected together through a variety of techniques, the preferred approach is to screw them together and then mount the sections sequentially in an outer antenna housing 64 with the latter serving to hold the antenna elements in confined alignment. Accordingly, when the antenna is assembled and positioned at its lowered operating position, the lower support surface 46 of the gimballed structure 42 will rest on and engage surface 56 in the trumpet 34 of the lower winding section 32. This is shown in full line in FIG. 2. When in its raised position, shown in phantom in FIG. 2, the upper gimballed support surfaces 44 will be in contact with or will have been moved upwardly toward conical surface 50 in the upper winding section 30, so that surfaces 46 and 56 are disengaged.

When the lower gimballed support surfaces 46 are in contact with surface 56, core 40 will be mounted and balanced within the hollow interior of the winding sections in a gimballed manner and be able to move independently therein. Because of this mounting arrangement, mechanically induced shocks or vibrations will be effectively prevented from affecting core 40 and the mechanical natural resonant frequency of the core, and of the antenna, will be greatly reduced.

Located directly adjacent, but below the lower winding section 32 is a separate housing member, generally indicated at 66, which includes an outer vertical wall portion 68 and an integrally formed inwardly directed horizontal wall member 70 provided with a central aperture 72. Wall 70 is positioned a predetermined distance below the juncture between the distal end of the trumpet 34 of the lower winding section 32 and the top edge of wall portion 68 so as to define an upper chamber 74 and a lower chamber 76 on opposite sides thereof.

Positioned in upper chamber 74 is a temperature responsive structure, shown in the form of a multi-fingered bi-metallic device 78, that is temperature activated to cause the fingers to move and either raise or lower core 40 in response to temperature changes. This device will, accordingly, provide protection of the assembled gimballed core by engaging the core and lifting it vertically thereby preventing stresses in the gimballed mount that might be induced by handling during transit or when being inserted in the downhole. By employing a temperature responsive device that will engage and lift core 40 below a certain temperature, as shown in phantom, for example, below about 50° C., it will permit the gimballed support to be operative only above the chosen temperature. Core 40 preferably has a weight of about 2 to 3 pounds so that it can be easily lifted without the application of great force. It should be understood that this unloading or stress relieving of the gimballed support is desired to protect such support during handling, and other methods or techniques could be employed other than the bi-metallic member as shown. For example, the core could be lifted from above or could otherwise be lifted by electrically actuated means.

Also, in the temperature actuated approaches, the temperature chosen should preferably be at a mid-range point between surface and downhole temperatures. In this way, the gimbal support will be inoperative at the surface and will slowly move into its operative position as the temperature of the device approaches and passes above the desired temperature. There will be, in effect, a built-in time delay as the increasing temperature enters the device gradually and heats the unit as it is inserted into the borehole.

Figure 6:
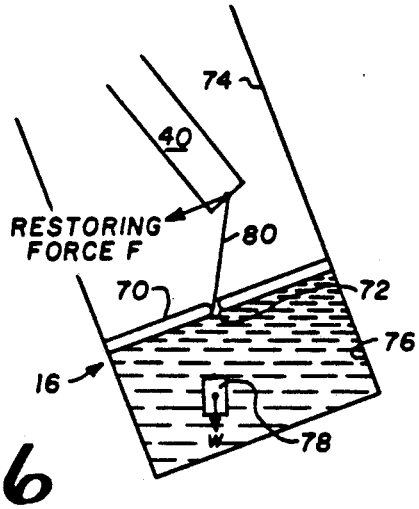
FIG. 6 is a diagrammatic showing of the restoration force for the core acting when the assembly is installed in an inclined well and vibrations have moved the core.

In order to provide a restoring force for core 40, should it pivot within the hollow winding, a weight 78 is attached to the bottom of core 40 by means of a connecting wire 80. Thus, as shown in FIG. 6, where the assembly 15 is shown installed in a wellbore that is inclined, weight 78 will provide a restoring force in the direction of arrow F as shown and move the gimballed core 40 in the same direction back toward its centered gimballed position if it should have moved away from this position.

Figure 7:
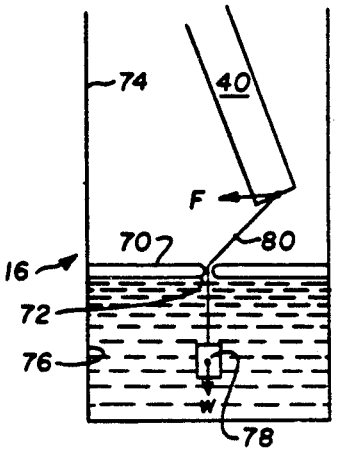
FIG. 7 is a diagrammatic view showing use of an oil damped restoration force for the core in the downhole where vibrations have moved the core.

Should the gimballed core 40 be moved, as shown in FIG. 7, the weight 78 will continue to provide a restoring force, again in the direction of arrow F for the movement shown, opposite to the direction in which the gimballed member moved.

Figure 8:
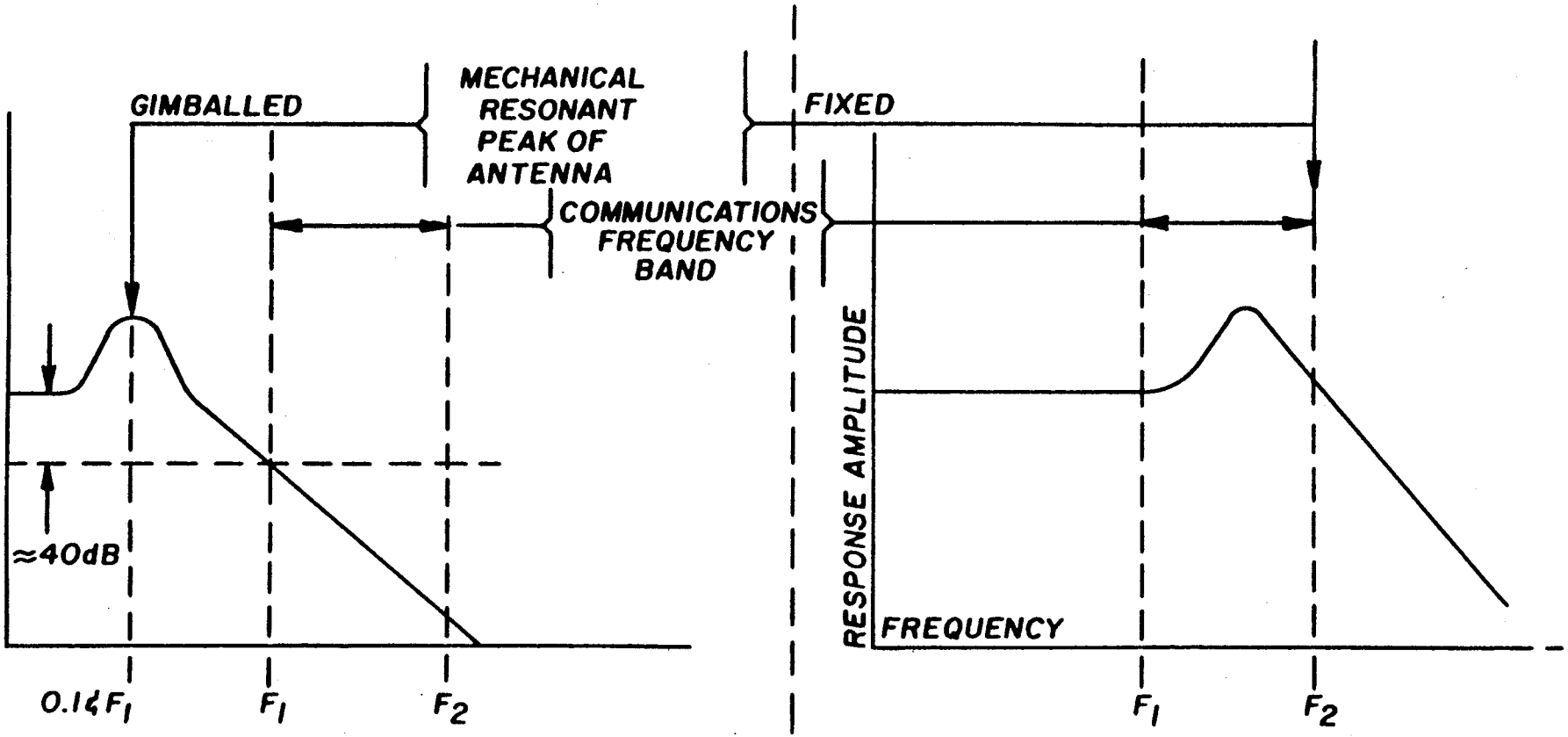
FIG. 8 is two graphs that show the response amplitude at certain frequencies of both fixed and gimballed antenna structures, demonstrating how the frequency of the mechanical resonant peak of the gimballed antenna is substantially reduced.

With reference now to FIG. 8, the right hand graph sets forth the response amplitude of a fixed antenna structure. Assuming the frequency band for antenna communication purposes lies between frequency values of F1 and F2, the mechanical resonant peak for the fixed antenna is above or within the communication frequency band. There exists, therefore, the possibility of an error being introduced into the control system by means of mechanically induced vibrations creating frequency signals similar to the frequencies being transmitted from the surface to the subterranean antenna.

With reference now to the left hand graph in FIG. 8, it can be seen that the mechanical resonant peak for the gimballed antenna, according to the present invention, is moved to a much lower frequency of about 0.1 times the F1 frequency. The initial flat response followed by the rise for the resonant point is then followed by a tailing off of the signal and there is about a 40 dB difference in the response amplitude by the time the lowest frequency chosen for the communications band is reached. This demonstrates that relative to the amplitude of the mechanical frequency F1 coupled to the outside of the antenna, the core itself is going to be exhibiting a natural resonant frequency whose amplitude is 40 dB below that point, thereby resulting in a tremendous attenuation of the sympathetic response between that of the core and of the lowest electrical signal frequency within the communication band.

With respect to the other side of the communication band at F2, the amount of sympathetic resonance amplitude of the gimballed antenna will be even less than at the F1 point so that for the communication band width, F1, F2 as shown, the gimballed core is substantially unsympathetic to those amplitudes above the lowered resonant peak of the antenna. Since the natural mechanical resonant frequency of the core is reduced to substantially less than that of the lowest electromagnetic signal frequency of the communication band chosen for that antenna, mechanically induced vibrations will not result in the generation of any sympathetic frequency signals that would incorrectly trigger responses by the downhole system 16.

Figure 3:
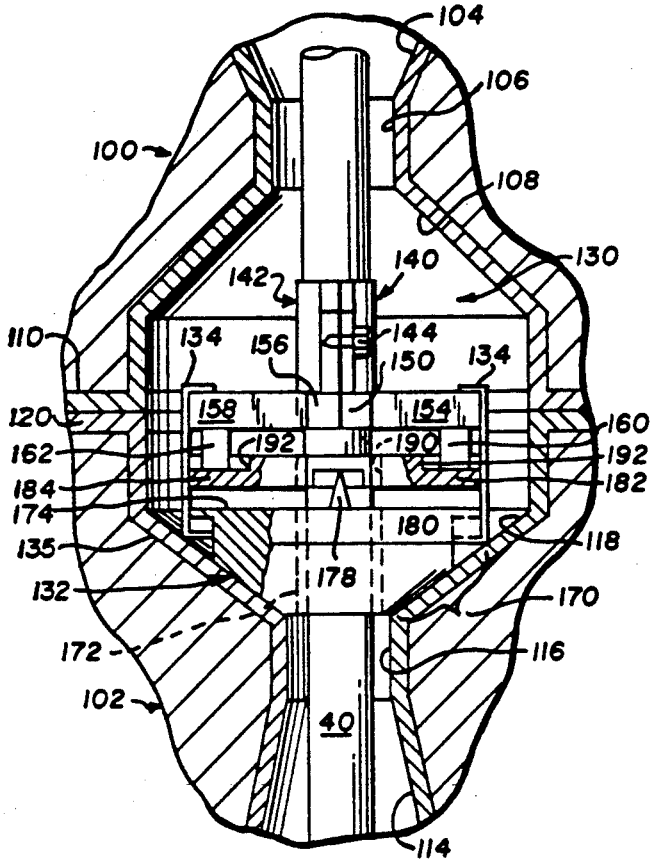
FIG. 3 is a diagrammatic, side elevation view of the mounting structure according to another embodiment of the present invention.
Figure 4:
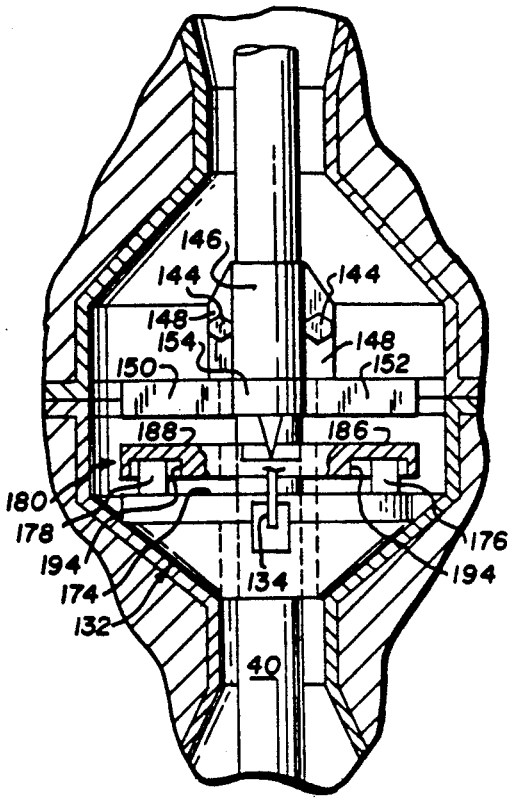
FIG. 4 is a diagrammatic cross-sectional view taken along line 4—4 in FIG. 3.

Turning now to FIGS. 3 and 4, a second embodiment is shown that includes similar winding sections as described with respect to FIG. 2, these generally being indicated for the upper and lower sections at 100 and 102. Similarly, the hollow interior portion of the winding is defined by an upper conically shaped trumpet member 104 which terminates in a short vertically positioned cylindrical section 106 with the trumpet member flaring outwardly from therebelow to define a conical section 108 which a short, cylindrical wall section 109 depends and the trumpet terminates at a horizontally outwardly extending flange 110. With respect to the bottom section 102, the lower conically shaped trumpet member 114 also includes a cylindrical section 116 and thereabove tapers outwardly to define another conical section 118. A short cylindrical wall portion 119 extends upwardly from conical section 118 and includes a horizontal outwardly extending flange 120. The gimballed mounting structure includes an upper clamping element generally indicated at 130 and a lower frame portion 132 which are loosely held together by means of outer connecting frame elements 134 the top ends of which are respectively fixed to the upper clamping element 130 as by welding or other convenient means. Frame elements 134 do not rigidly connect the upper and lower frame members 130 and 132 and will not normally connect or engage the lower frame portion 132. Rather, frame elements 134 is designed to connect those upper and lower frame members together only when core 40 is lifted into an inoperative position. In that instance, the bottom portions of frame elements 134 will engage and lift the lower frame portion 132 as, for example, by forming the elements 134 with an inwardly directed tongue 133 that will engage the underside of a lip 135 formed in the outer periphery of lower frame portion 132.

Figure 5:
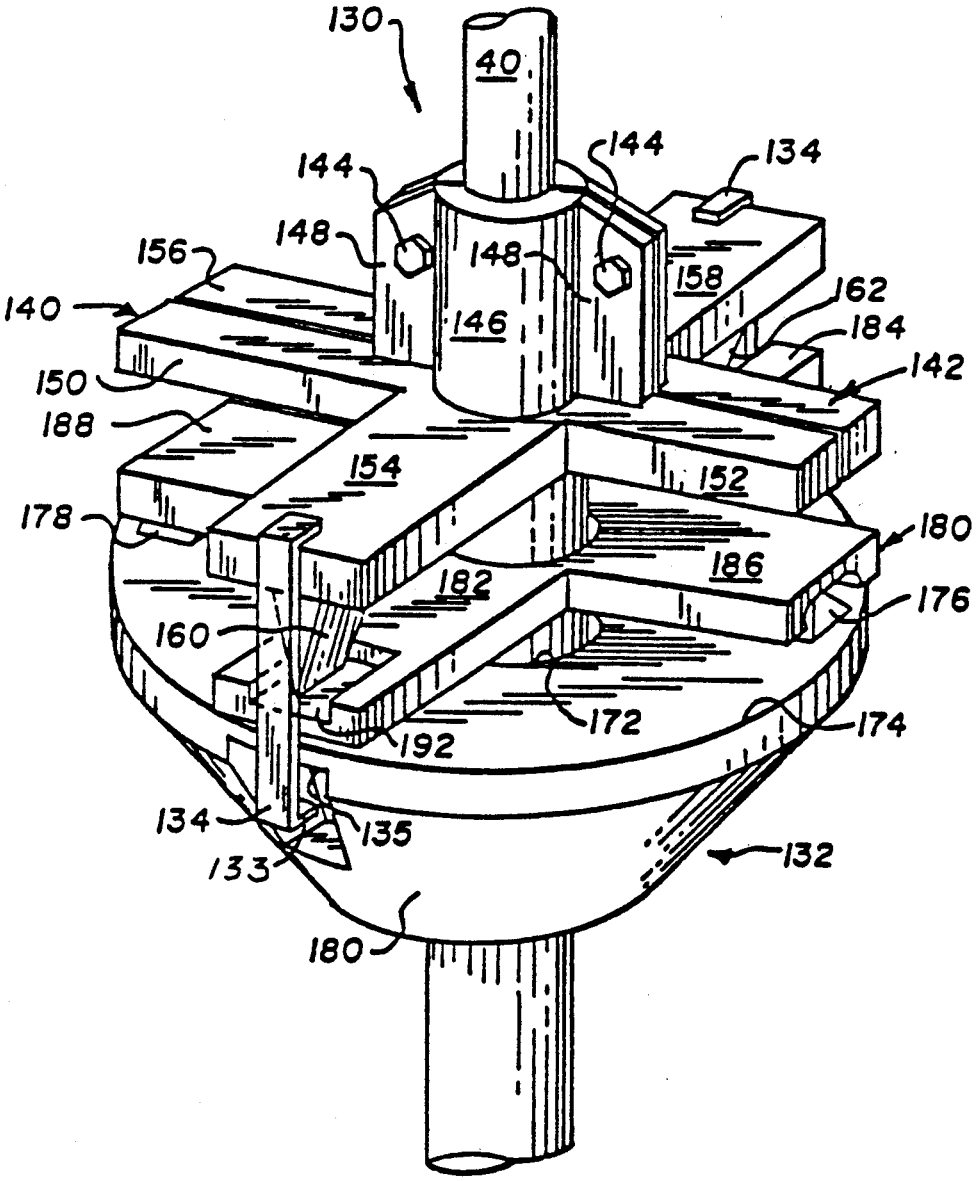
FIG. 5 is a diagrammatic partial perspective of the gimballed mounting arrangement shown in FIGS. 3 and 4.

Upper frame member 130 is divided into two halves 140 and 142 that are secured to core 40 by bolts 144 acting through an upstanding collar portion 146 and integrally formed flanges 148 provided on each half. Integrally formed with the collar portion 146 on half 140 are horizontal arms 150 and 152, as in FIGS. 4 and 5, and each extends radially outwardly from opposite sides of collar 146, parallel to mounting flanges 148. A third horizontal arm 154 extends radially outwardly from the front of collar portion 146 perpendicular to arms 150 and 152. The other half 142 also includes two horizontal arms identical to arms 150 and 152, one of which is shown in FIG. 3 at 156, and a third radially extending arm 158 positioned perpendicular to arm 156 and diametrically opposed to arm 154. Arms 154 and 158 each include a downwardly directed knive edge element 160 and 162, respectively, that form the X-axis knives, whose funtion will be more fully explained below.

The lower frame member 132 is in the form of a solid inverted cone having a tapering exterior 170 that is complementary to the surface of conical section 118 and on which it will rest when core 40 is in its operating position. The lower frame member 132 includes a hollow central opening 172 through which core 40 extends with opening 172 being dimensioned sufficiently larger than the diameter of core 40 to allow pivoting movement of core 40 therein. The upper surface 174 thereof includes a pair of diametrically opposed, upwardly directed knife edges 176 and 178 that together form the Y-axis knives.

Positioned between the upper and lower frame members is a knife edge support member 180 having four radially extending arms 182, 184, 186 and 188 and a central aperture 190 through which core 40 passes. One pair of opposed arms 182 and 184, shown in FIG. 3, each include an upwardly opening depression, cut out or groove 192 for receiving knife edges 160, 162, respectively. The other pair of opposed arms 186 and 188, shown in FIG. 4, each include a downwardly opening depression, cut out or groove 194 to receive knife edges 176 and 178, respectively. The bottoms or innermost surfaces of those depressions, cutouts or grooves all preferably lie on a common plane so that the support edges of each of the knives 160, 162, 176 and 178 all lie substantially on common plane. Further, the clamp comprised of frame members 140, 142 and bolts 144 are clamped on core 40 so that when the gimballed mounting assembly is in its operating position, the plane defined by the bottoms of the grooves engaged by the knife edges passes through the center of gravity of core 40.

The gimballed core support, accordingly, takes the form of a two axis, knife edge system that will effectively isolate core 40 from a substantial amount of mechanically induced vibration and simultaneously effectively lower the natural resonant frequency of the antenna.

It should be understood that the upper frame member 140 and the knife edge support member 180 could have forms or shapes other than that shown. For example, rather than having four arms, they could be in one-piece plate or disc members or indeed have other shapes depending upon needs and desires. It should be understood that what is important is to establish the desired location and positioning of the two pairs of knife edges, about core 40 and in a plane positioned at the center of gravity of core 40.

In its operating position, the gimballed mounting system as shown in FIGS. 3 and 4, will have the bottom support member 132 resting on the conical support surface 118. In its inoperative position, core 40 will be raised which, in turn, raises both the upper and lower frames, the latter occurring after a predetermined amount of vertical movement via frame elements 134 so as to unseat the lower frame member 132 from conical section 118. In this manner, this gimballed support will be protected.

While the gimballed structure is shown as using the X axis knife edges 160 and 162, and the Y axis knife edges 176 and 178, other forms of gimballing could also be used, such as ball bearings. It is important, however, that the gimbal coupling be relatively stictionless, and in order to minimize stiction the knife edge approach is preferred.

The use of a weight 78 assures that under any form of external motion during downhole flow conditions, the gimballed magnetic core 40 will be returned to or close to its centered position inside the hollow winding. In an effort to further dissipate oscillatory energy and to prevent sudden movements of the magnetic core 40 within the winding structure, it is also possible to provide additional damping within chamber 76 such as by submerging the weight 78 in a viscous fluid, such as oil, to further aid in dissipating oscillatory energy and hasten the gimballed magnetic core in returning to its desired centered position.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the specification and the appended claims, which scope is to be accorded the broadest interpretation so as to encompass all such modifications and equivalent structures.

I claim:

1. A low frequency electromagnetic subterranean antenna, for use underground as part of a borehole communication system having a communication band chosen for the antenna including:

a winding member having a hollow interior and a winding;

a core member within said interior; and mounting means to effect mechanical isolation of the core member by mounting said core member within the winding member in a balanced, pivotally movable manner at the center of gravity of the core member within said borehole communication system so that the mechanical natural resonant frequency of the antenna is less than that of the lowest electromagnetic signal frequency of said communication band.

2. An antenna as in claim 1, wherein said core member is mounted by means of a gimballed mounting device which permits said core member to incline freely to effect isolation from mechanically induced vibrations.

3. An antenna as in claim 2, wherein said material is permalloy 80 Ni.

4. An antenna as in claim 1, wherein said core member is comprised of a single, high magnetic permeable material.

5. An antenna as in claim 1, wherein the natural mechanically induced resonant frequency of the antenna is about ten times less than the lowest electromagnetic signal frequency of the communication band chosen for the antenna.

6. An antenna as in claim 1 further including restoring means for restoring said core member to a centered position within said hollow winding member.

7. In a low frequency electromagnetic borehole communication system including a subterranean antenna for receiving transmitted signals, the improvement comprising an antenna having an electrical winding including means for defining a hollow interior chamber therein and core member means mounted planarly movable about its center of gravity within said hollow interior chamber whereby the core member is insulated from induced vibrations and has a lowered natural resonant frequency.

8. An antenna structure for a bore hole electromagnetic communication system, said antenna including an outer winding member having a longitudinal axis, means defining a hollow internal chamber extending generally in the direction of said longitudinal axis, said chamber means including means defining a support surface therein, a separate magnetic core member dimensioned to be smaller than said chamber means, and core mounting means for gimbally mounting said core member on said support surface with said core member pivotally balanced at its center of gravity.

* * * * *